United States Patent [19]

Robichaud et al.

[11] Patent Number: 4,925,034

[45] Date of Patent: May 15, 1990

[54] PACKAGE FITMENT

[75] Inventors: Arthur R. Robichaud, Worthington; Frank R. Wilgus; Warren C. Tyler, both of Powell, all of Ohio; Jack Holmes, Cowiche, Wash.

[73] Assignee: Combibloc, Inc., Columbus, Ohio

[21] Appl. No.: 354,365

[22] Filed: May 19, 1989

[51] Int. Cl.[5] ..... B65D 5/70

[52] U.S. Cl. ..... 206/603; 206/620; 206/628; 220/267; 220/277; 493/87

[58] Field of Search ..... 206/603, 620, 626, 628, 206/621.3, 621.7; 220/258, 266, 267, 277; 493/87, 374

[56] References Cited

U.S. PATENT DOCUMENTS

| | | | |
|---|---|---|---|
| 2,642,203 | 6/1953 | Seemuller | 220/277 |
| 2,820,585 | 1/1958 | Nerenberg et al. | 206/621.7 |
| 3,371,818 | 3/1968 | Bozek | 220/267 |
| 3,853,242 | 12/1974. | Zundel | 220/277 |
| 3,912,128 | 10/1975 | Ziemann et al. | 222/541 |
| 3,981,412 | 9/1976 | Asmus | 220/258 |
| 4,059,201 | 11/1977 | Foster | 220/267 |
| 4,331,256 | 5/1982 | Helms | 220/267 |
| 4,411,370 | 10/1983 | Rausing | 220/258 |
| 4,463,866 | 8/1984 | Mandel | 220/258 |

FOREIGN PATENT DOCUMENTS

| | | | |
|---|---|---|---|
| 3832412 | 4/1989 | Fed. Rep. of Germany . | |
| 945985 | 1/1964 | United Kingdom | 220/278 |

*Primary Examiner*—Gary Elkins

*Attorney, Agent, or Firm*—Porter, Wright, Morris & Arthur

[57] ABSTRACT

A fitment for a package is stamped out of polystyrene strips and then hot melt adhesive bonded to the package so that a tab portion of the fitment overlies an openable flap formed by a score line in the package. The package is opened by rotating the tab so that the forward portion of the tab pushes the openable flap into the container. Since the forward portion of the tab is adhesively bonded to the openable flap, when a frangible connection between the tab and base fractures, the openable flap and tab can be removed to thereby expose an opening in the package. Rotation of the tab is initiated by pushing downwardly on the forward portion of the tab in order to fracture the score line of the package.

13 Claims, 1 Drawing Sheet

PACKAGE FITMENT

BACKGROUND OF THE INVENTION

1. Field of the Invention

The present invention relates generally to packages and containers for liquids and, more specifically, to fitments having package opening features and a removable tab.

2. Description of the Related Art

Paperboard cartons for beverages are generally well known. Probably the most familiar type is the milk carton which is provided with a gabled top, one end of which is designed to be folded back and then forwardly to provide a pouring spout. After use, the pouring spout is then folded back again to close the carton.

It is well known to provide score lines on paperboard packages to provide means for opening the package. For example, in one type of paperboard package having a flattened gable, a score line is provided as a straight line across the tip of one of the gabled ends to facilitate removal of the gable tip by tearing. Then, liquid contained in the package can be poured out of the opening formed by tearing of the gable.

Many different types of closures having package opening and reclosing features are known. European patent application no. 0291112A2 describes a closure which is attached to the top lid of the container. The device includes a base portion and a movable portion preferably hinged thereto. The base portion has a dispensing aperture, a depending flange encircling the aperture and a deformable pouring lip/drain surface. The device is designed to be attached by pushing the depending flange of the base portion through a prescored or pre-cut aperture in the container's top. Thus, the closure of the aforementioned European patent application is not attached to the package prior to opening.

U.S. Pat. No. 4,247,014 to Walz describes a self-contained opener for hollow containers such as thin walled beverage cans. The apparatus provides a can cover including a flat portion and a pull tab respectively having first and second mating portions mutually fixed and permanently interconnected, located either fixedly in the cover or together rotatable with the flat portion inwardly of the can as it is opened. The pull tab has an annular end portion encircling the opening formed by breaking the flat portion, and covers the wall edge of the opening in its final protective position. Due to the fact that the container is a metal can the pull tab is riveted approximately to the center of the top of the can.

U.S. Pat. No. 3,977,561 to Strobe et al. describes a pull tab which is rotated nearly 180° to seat over an opening left by a tear tab which is pushed inwardly and to the side of the can. The pull tab has a central opening for dispensing liquid.

U.S. Pat. No. 4,629,088 to Durgin describes a beverage container lid including a foldable flap which may be opened to allow a user to drink from a beverage container which is covered by the lid. A recess in the beverage container lid is provided to receive the opening flap and to firmly secure the flap in its opened position. The recess includes a pair of detents on either side and an overhang at one end which cooperate to hold the flap firmly within the recess.

The aforementioned patents represent a cross-section in the state of the art of closures and fitments. A continuing need exists for closures and/or fitments which are easy to operate by the consumer, and expensive to manufacture so as not to add significantly to the cost of the beverage contained in the package.

SUMMARY OF THE INVENTION

An object of the present invention is to provide a fitment which is separately attachable to a package over a scored region thereof.

Another object of the present invention is to provide a fitment which is relatively simple in construction and cost effective to produce.

Another object of the present invention is to provide a fitment, the operation of which can be easily understood by the consumer of beverages.

These and other objects of the invention are met by providing a package opening fitment for attachment to a package having a score line forming an openable flap, the fitment including a base having upper and lower surfaces and a longitudinally extending opening which at least partially overlies the openable flap of the package when the fitment is attached to the package, the opening having two longitudinal sides, a tab pivotally connected to the base at the opposite sides of the base opening through a frangible connection and overlying the openable flap when the fitment is attached to the package and being normally co-planar with the base and having upper and lower surfaces and forward and rearward portions defined by a pivot axis of the tab, and means for attaching the lower surface of the base and the forward portion of the tab to the package.

Another object of the present invention is to provide the user of the single service liquid (semi-liquid) box with an easy and convenient method of opening and dispensing by pouring over the lip of the fitment and/or by drinking directly from the container, as in the case of a poptop can.

These objects, together with other objects and advantages which will be subsequently apparent reside in the details of construction and operation of the fitment as more fully hereinafter described and claimed, reference being had to the accompanying drawings forming a part hereof, wherein like reference numerals refer to like parts throughout.

DETAILED DESCRIPTION OF THE PREFERRED EMBODIMENTS

Figure 1:
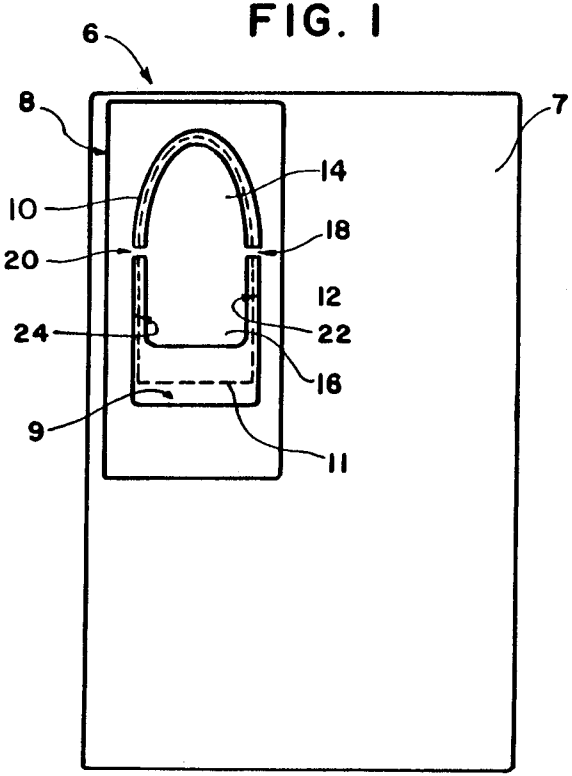
FIG. 1 is a top plan view of a first, preferred embodiment of the present invention.
Figure 2:
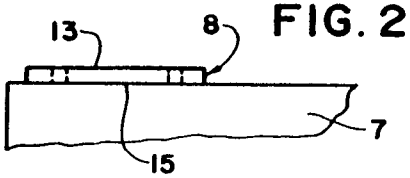
FIG. 2 is a side elevational view of the embodiment of FIG. 1.

Referring now to FIGS. 1 and 2, a fitment according to the present invention is generally referred to by the numeral 6. The fitment 6 is adhesively bonded by a hot melt glue to the top surface of a package 7. The fitment 6 includes a base 8 having upper and lower surfaces 13 and 15, respectively, and a longitudinally extending opening formed by two opening portions 9 and 10. The base 8 at least partially overlies an openable flap defined by a score line 11.

A tab 12 is pivotally connected to the base 8 at the opposite sides of 22 and 24 of the base opening (formed by opening portions 9 and 10). The connection between the tab and the base 8 is a frangible connection, meaning that when the tab is pivoted, a shearing force is exerted on plastic pieces 18 and 20 which form the frangible connection. The plastic pieces 18 and 20 bridge the opening of the base 8 and provide an interconnection between the tab 12 and the base 8.

Prior to opening the package 7, the base 8 and tab 12 generally comprise a flat rectangular piece of plastic, with an elongated, longitudinally extending opening defined by the two opening segments 9 and 10. The fitment 6 is preferably manufactured by excluding sheets of polystyrene, which is a relatively rigid plastic, and cutting the sheets into long strips. The strips are cut to a width which coincides with the width of the fitment 6. Then, a stamp having the shape of the opening 9 and 10 is pressed onto the cut strips of polystyrene to thereby form the illustrated structure. After forming the opening, a hot melt adhesive is applied to the lower surface 15 of the base at forward and rearward portions thereof, and also on the lower surface of the tab 12 at the forward portion 14. Thus, the base 8 is securely fastened to the top of the package 7 and the forward portion of the tab 12 is attached to the openable flap defined by the score line 11.

When opening the package 7, the forward portion 14 of the tab 12 is pushed inwardly into the package, thereby breaking the score line and opening the package. After the tab has rotated approximately 20° to 30°, the frangible connection breaks, thereby separating the tab 12 from the base. The tab is then further rotated so as to fold the openable flap inwardly upon itself to form a Z-fold. The tab can then be lifted away from the base, thereby completely severing the opening flap from the top of the package 7. This has the advantage that the openable flap which is normally pushed into a box will not obstruct liquid as it is poured from the package.

Figure 3:
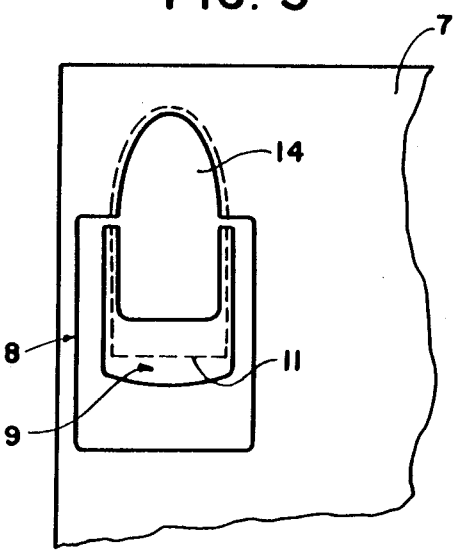
FIG. 3 is a top plan view of a second, preferred embodiment of the present invention.

An alternative embodiment is illustrated in FIG. 3, wherein the fitment 6 has a longitudinal opening 9 formed in the base 8. The tab 12 is stamped such that the forward portion 14 protrudes beyond the forward end 17 of the base 8. The end 17 of the base 8 is positioned so that the forward portion 14 of the tab 12 overlies the forward portion of the openable flap. As in the previous embodiment, a hot melt adhesive is applied to the lower surface of the base 8 and the lower surface of the forward portion of the tab 12. The opening sequence is similar to the previous embodiment, wherein the forward portion 14 of the tab 12 is pushed inwardly into the container to fracture the score line 11 at the forward portion of the openable flap. After about 20° to 30° of rotation, the frangible connection breaks so that the tab 12 becomes separated from the base 8. After separation, the tab 12 can be pulled away from the top of the package 7 to thereby remove the openable flap defined by the score line 11.

The embodiment illustrated in FIG. 3 can be manufactured quickly and inexpensively in the same manner as in the previous embodiment. Specifically, strips of plastic material can be stamped at high speed to form the illustrated structure.

The many features and advantages of the present invention are apparent from the detailed specification, and thus, it is intended by the appended claims to cover all such features and advantages of the fitment which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modification and equivalents may be resorted falling within the scope and the spirit of the invention.

What is claimed is:

1. A fitment attachable to a package having a score line forming an openable flap, the fitment comprising:

a base having upper and lower surfaces and a longitudinally extending opening which at least partially overlies the openable flap of a package when the fitment is attached to the package, the opening having two longitudinal sides;

a tab pivotally connected to the base at the opposite sides of the base opening through a frangible connection and overlying the openable flap when the fitment is attached to the package and being normally co-planar with the base, and having upper and lower surfaces and forward and rearward portions, the forward and rearward portions being defined by a pivot axis of the tab; and means for attaching the lower surface of the base and forward portion of the tab to a package.

2. A fitment according to claim 1, wherein the attaching means comprises a hot melt adhesive.

3. A fitment according to claim 1, wherein the base and tab are stamped from a strip of extruded polystyrene material.

4. A fitment according to claim 1, wherein the tab is formed within the base in the base opening.

5. A fitment according to claim 1, wherein the tab has a forward portion which protrudes beyond one end of the base.

6. A fitment according to claim 1, wherein the frangible connection comprises plastic material formed between and integrally with the tab and the base.

7. A container for dispensing liquids comprising:

a paperboard package having a top and a score line forming an openable flap in the top;

a fitment connected to the package, the fitment including, a base having upper and lower surfaces and a longitudinal extending opening which at least partially overlies the openable flap of the package, the opening having two longitudinal sides, a tab pivotally connected to the base at the opposite sides of the base opening through a frangible connection and overlying the openable flap and being normally co-planar with the base and having upper and lower surfaces and forward and rearward portions, the forward and rearward portions being defined by a pivot axis of the tab; and means for attaching the lower surface of the base and forward portion of the tab to the package.

8. A package according to claim 7, wherein the attaching mean comprises a hot melt adhesive.

9. A package according to claim 7, wherein the base and tab are stamped from a strip of extruded polystyrene material.

10. A package according to claim 7, wherein the tab is formed within the base in the base opening.

11. A package according to claim 7, wherein the tab has a forward portion which protrudes beyond one end of the base.

12. A package according to claim 7, wherein the frangible connection comprises plastic material formed between and integrally with the tab and the base.

13. A method of opening a package having a score line forming an opening flap, the method comprising attaching a fitment which includes a base and a tab to the package so that the tab overlies the openable flap of the package;

rotating the tab to thereby fracture the score line and push the openable flap inwardly into the package until a frangible connection between the tab and base breaks; and pulling the tab away from the package to thereby remove the tab and openable flap.

* * * * *